US011027335B2

(12) United States Patent
Take

(10) Patent No.: US 11,027,335 B2
(45) Date of Patent: Jun. 8, 2021

(54) SINTERED BODY MANUFACTURING APPARATUS AND SINTERED BODY MANUFACTURING METHOD

(71) Applicant: Sumitomo Electric Sintered Alloy, Ltd., Takahashi (JP)

(72) Inventor: Ryota Take, Takahashi (JP)

(73) Assignee: Sumitomo Electric Sintered Alloy, Ltd., Takahashi (JP)

( * ) Notice: Subject to any disclaimer, the term of this patent is extended or adjusted under 35 U.S.C. 154(b) by 378 days.

(21) Appl. No.: 15/739,387

(22) PCT Filed: Mar. 14, 2016

(86) PCT No.: PCT/JP2016/057888
§ 371 (c)(1),
(2) Date: Dec. 22, 2017

(87) PCT Pub. No.: WO2017/002404
PCT Pub. Date: Jan. 5, 2017

(65) Prior Publication Data

US 2019/0217388 A1 Jul. 18, 2019

(30) Foreign Application Priority Data

Jun. 29, 2015 (JP) ..... JP2015-130184

(51) Int. Cl.

| | |
|---|---|
| ***B29C 67/04*** | (2017.01) |
| ***B22F 3/16*** | (2006.01) |
| ***B22F 3/00*** | (2021.01) |
| ***B22F 3/24*** | (2006.01) |

(52) U.S. Cl.
CPC ..... *B22F 3/162* (2013.01); *B22F 3/003* (2013.01); *B22F 3/24* (2013.01); *B22F 2003/247* (2013.01); *B22F 2998/10* (2013.01); *B22F 2999/00* (2013.01)

(58) Field of Classification Search
CPC ..... B29C 69/00; B29C 69/001; B29C 69/02; B29C 67/04; B29C 43/006; B29C 43/32; B29C 43/36; B29C 43/50; B22F 3/00; B22F 3/001; B22F 3/003; B22F 3/12
See application file for complete search history.

(56) References Cited

U.S. PATENT DOCUMENTS

2004/0045637 A1 3/2004 Tanaka et al.
2005/0269016 A1* 12/2005 Oldani ..... B29C 70/42 264/175

FOREIGN PATENT DOCUMENTS

| | | | |
|---|---|---|---|
| CN | 1635981 | A | 7/2005 |
| JP | H03-006303 | A | 1/1991 |
| JP | 2002-008935 | A | 1/2002 |
| JP | 2002-372373 | A | 12/2002 |

(Continued)

*Primary Examiner* — Thu Khanh T Nguyen
(74) *Attorney, Agent, or Firm* — Baker Botts L.L.P.; Michael A. Sartori

(57) ABSTRACT

A sintered body manufacturing apparatus includes a compacting apparatus configured to press a raw powder containing a metal powder into a green compact, a machining apparatus configured to perform a cutting operation on the green compact to produce an unsintered materials, and a green compact conveying path configured to connect the compacting apparatus in series to the machining apparatus to convey green compacts one by one from the compacting apparatus to the machining apparatus.

10 Claims, 8 Drawing Sheets

(56) References Cited

FOREIGN PATENT DOCUMENTS

| | | | |
|---|---|---|---|
| JP | 2003-303728 | A | 10/2003 |
| JP | 2004-323939 | A | 11/2004 |
| JP | 2006-336078 | A | 12/2006 |

* cited by examiner

SINTERED BODY MANUFACTURING APPARATUS AND SINTERED BODY MANUFACTURING METHOD

TECHNICAL FIELD

The present invention relates to a sintered body manufacturing apparatus used to manufacture sintered bodies, and a sintered body manufacturing method that can use the manufacturing apparatus.

BACKGROUND ART

Sintered bodies obtained by sintering green compacts containing metal powders, such as iron powders, are used as automotive parts, general machinery parts, and the like. Exemplary types of such parts include sprockets, rotors, gears, rings, flanges, pulleys, and bearings. Sintered bodies are generally manufactured by pressing a raw powder containing a metal powder into green compacts and then sintering the green compacts.

For example, some sintered bodies used as automotive parts have through holes passing therethrough, such as oil holes, or blind holes not passing therethrough. Such a sintered body is manufactured by sintering a green compact and then making a hole in (or performing a cutting operation on) the sintered green compact with a drill (PTL 1).

CITATION LIST

Patent Literature

PTL 1: Japanese Unexamined Patent Application Publication No. 2006-336078

SUMMARY OF INVENTION

Technical Problem

Making a hole in a sintered body with a drill is difficult and less productive. This is because since sintered bodies are much harder than unsintered green compacts, it tends to take more machining time to make a hole in a sintered body. Since green compacts are obtained simply by compacting a raw powder, particles of a metal powder in the green compacts are mechanically bonded together. On the other hand, particles of a metal powder in sintered bodies are diffusion-bonded and alloyed by sintering, and thus are firmly bonded together.

This not only makes it difficult to improve productivity, but also makes it more likely to shorten tool life. Flaws, such as cracks, may be created in the sintered body, depending on the machining location in the sintered body.

An unsintered green compact may be drilled to form a through hole therein in advance. This may improve productivity in the manufacture of sintered bodies. However, when a cutting operation is performed on the green compact, a difference in production time between compaction and machining is too large to continuously carry out the process from compaction to machining. Accordingly, a plurality of green compacts may be temporarily kept on a tray, which may then be conveyed to a machining apparatus where the green compacts are sequentially machined. In this case, temporarily keeping a plurality of green compacts on the tray may reduce productivity. Also, since green compacts are low in strength and brittle, they may be cracked by contact with other green compacts while being conveyed.

The present invention has been made in view of the circumstances described above. An object of the present invention is to provide a sintered body manufacturing apparatus that is capable of continuously carrying out the production and machining of green compacts and improving productivity in the manufacture of sintered bodies.

Another object of the present invention is to provide a sintered body manufacturing method that can use the sintered body manufacturing apparatus.

Solution to Problem

A sintered body manufacturing apparatus according to an aspect of the present invention includes a compacting apparatus, a machining apparatus, and a green compact conveying path. The compacting apparatus is configured to press a raw powder containing a metal powder into a green compact. The machining apparatus is configured to perform a cutting operation on the green compact to produce an unsintered material. The green compact conveying path is configured to connect the compacting apparatus in series to the machining apparatus to convey green compacts one by one from the compacting apparatus to the machining apparatus.

A sintered body manufacturing method according to another aspect of the present invention includes a compacting step and a machining step. The compacting step involves pressing a raw powder containing a metal powder into a green compact. The machining step involves performing a cutting operation on the green compact to produce an unsintered material. In the sintered body manufacturing method according to this aspect of the present invention, the compacting step and the machining step are carried out in an in-line manner.

Advantageous Effects of Invention

The sintered body manufacturing apparatus can improve productivity in the manufacture of sintered bodies.

With the sintered body manufacturing method described above, sintered bodies can be manufactured with high productivity.

DESCRIPTION OF EMBODIMENTS

Figure 1:
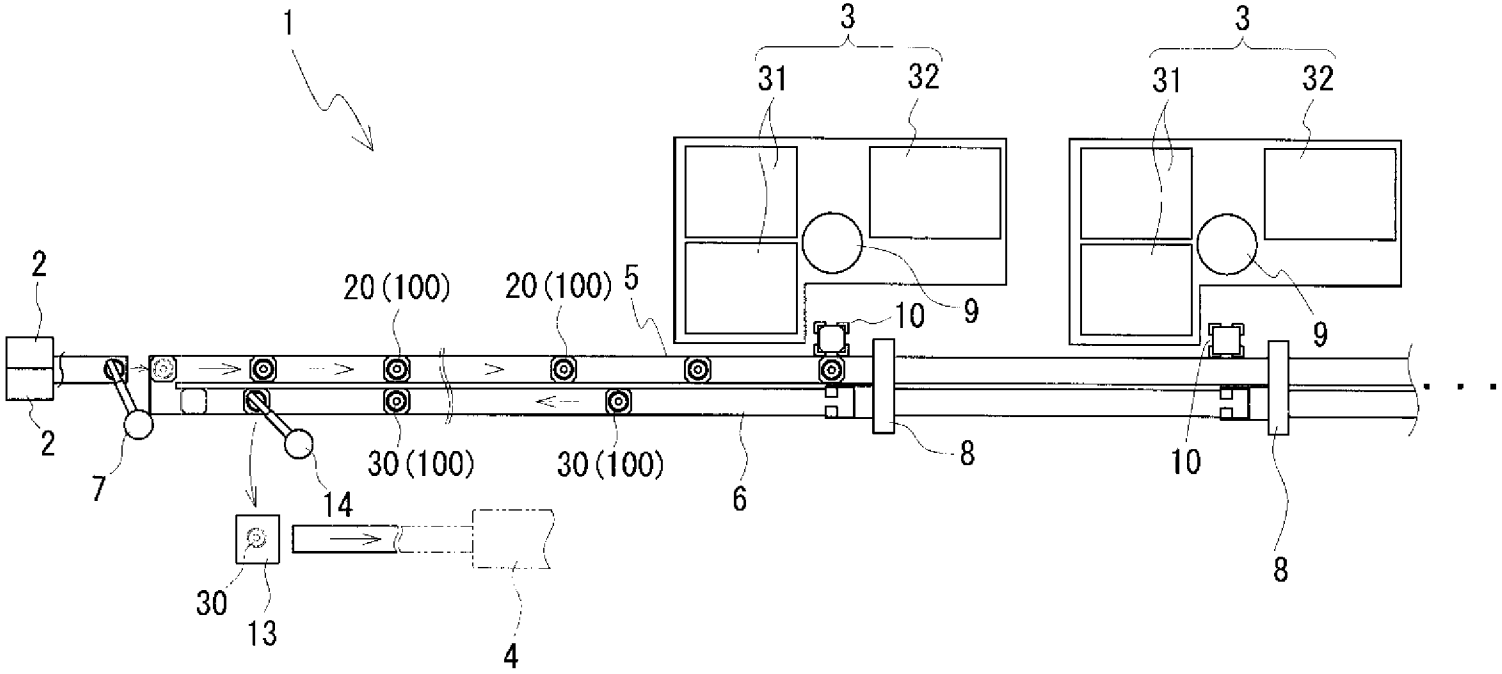
FIG. 1 is a top view illustrating an overview of a sintered body manufacturing apparatus according to a first embodiment.

<<Description of Embodiments of the Present Invention>>

First, embodiments of the present invention are listed.

(1) A sintered body manufacturing apparatus according to an aspect of the present invention includes a compacting apparatus, a machining apparatus, and a green compact conveying path. The compacting apparatus is configured to press a raw powder containing a metal powder into a green compact.

The machining apparatus is configured to perform a cutting operation on the green compact to produce an unsintered material (or an unsintered machined compact). The green compact conveying path is configured to connect the compacting apparatus in series to the machining apparatus to convey green compacts one by one from the compacting apparatus to the machining apparatus.

With this configuration, productivity in the manufacture of sintered bodies can be improved. This is because since, with the green compact conveying path, the green compacts can be sequentially conveyed to the machining apparatus every time a green compact is produced, the process from compaction to machining can be continuously carried out. That is, since there is no need to temporarily store a plurality of stacks of sintered bodies in parallel on a tray before their conveyance, it is possible to minimize loss of time from compaction to machining.

(2) An embodiment of the sintered body manufacturing apparatus may include a green compact transfer device configured to hold and transfer the green compact produced by the compacting apparatus to the green compact conveying path.

With this configuration, which includes the green compact transfer device, the green compact can be automatically transferred to the green compact conveying path. Therefore, although green compacts are more susceptible to damage, such as chipping or cracking, than sintered bodies, since they can be transferred without human error in the transfer operation, it is easy to reduce damage to green compacts in the course of their transfer to the green compact conveying path.

(3) Another embodiment of the sintered body manufacturing apparatus may include a standby stage and a conveying-side transfer device. The standby stage is disposed between the green compact conveying path and the machining apparatus. Before the green compact on the green compact conveying path is moved to the machining apparatus, the standby stage temporarily keeps the green compact on standby thereon, and before the unsintered material on the machining apparatus is transferred to a sintering furnace, the standby stage temporarily keeps the unsintered material on standby thereon. The conveying-side transfer device is configured to hold and transfer the green compact on the green compact conveying path to the standby stage, and hold and transfer the unsintered material on the standby stage to the sintering furnace.

With this configuration, the green compact is temporarily kept on standby on the standby stage which does not run. This eliminates the need to hold the green compact being conveyed and place it in the machining apparatus, and makes it easy to place the green compact on the machining apparatus.

(4) In another embodiment of the sintered body manufacturing apparatus including the standby stage, the machining apparatus may include M/N cutting devices if a relationship (described below) is satisfied; and the sintered body manufacturing apparatus may further include a machining-side transfer device configured to hold the green compact on the standby stage and attach the held green compact to each cutting device, and remove the unsintered material from the cutting device and place the removed unsintered material onto the standby stage. The relationship described above refers to "M/N=integer", where N represents production time in seconds required for one compacting apparatus to produce each green compact and M represents total machining time in seconds required to perform the cutting operation on each green compact. The machining-side transfer device is configured to sequentially attach the green compacts to each cutting device every N seconds.

With this configuration, even when there is a large difference between the production time required for one compacting apparatus to produce each green compact and the total machining time required to perform machining on each green compact, productivity in the manufacture of sintered bodies can be improved because the process from compaction to machining can be continuously carried out in series.

(5) In another embodiment of the sintered body manufacturing apparatus in which the machining apparatus includes M/N cutting devices, one of the M/N cutting devices may be a first-surface machining device configured to perform machining from a first surface of the green compact, and another of the M/N cutting devices may be a second-surface machining device configured to perform machining from a second surface of the green compact.

With this configuration, sintered bodies each requiring a cutting operation from both the first and second surfaces thereof can be manufactured.

(6) In another embodiment of the sintered body manufacturing apparatus including the first-surface machining device and the second-surface machining device, the machining-side transfer device may include two retainers and an arm. The two retainers are each configured to hold and release either of the green compact and the unsintered material. The arm is connected to the two retainers and configured to move the retainers between the standby stage, the first-surface machining device, and the second-surface machining device. The retainers are each freely switchable between holding and releasing the green compact and between holding and releasing the unsintered material.

With this configuration, which includes the two retainers and the arm, it is possible to hold a green compact on the standby stage, attach the held green compact to the first-surface machining device, remove the green compact from the first-surface machining device, attach the green compact removed from the first-surface machining device to the second-surface machining device, remove an unsintered material from the second-surface machining device, and place the unsintered material removed from the second-surface machining device onto the standby stage.

Particularly with the two retainers, it is possible, with the green compact and the unsintered material being attached to the first-surface machining device and the second-surface machining device, to easily and quickly replace the green compact attached to the first-surface machining device with the green compact held on the standby stage, and replace the green compact on the standby stage with the unsintered material removed from the second-surface machining device. The method of replacement will be described in detail later on.

(7) Another embodiment of the sintered body manufacturing apparatus in which the machining apparatus includes a plurality of machining devices may include a marking apparatus. The marking apparatus is disposed between the machining apparatus and the sintering furnace, and configured to provide a marking for identifying a machining history of the unsintered material.

With this configuration, which includes the marking apparatus, it is possible to manufacture sintered bodies each provided with a marking having machining history information. Since the machining history of the sintered body can be identified by simply checking the marking, it is easy to identify the machining history of the sintered body.

(8) Another embodiment of the sintered body manufacturing apparatus may include a tray configured to hold each green compact thereon and conveyed by the green compact conveying path.

With this configuration, which includes the tray, it is possible to reduce contact of the green compact with the edge of the green compact conveying path during conveyance of the green compact, and thus to easily reduce damage to the green compact in the course of conveyance.

(9) A sintered body manufacturing method according to another aspect of the present invention includes a compacting step and a machining step. The compacting step involves pressing a raw powder containing a metal powder into a green compact. The machining step involves performing a cutting operation on the green compact to produce an unsintered material. In the sintered body manufacturing method according to this aspect of the present invention, the compacting step and the machining step are carried out in an in-line manner.

With this configuration, sintered bodies can be manufactured with high productivity. This is because by carrying out the compacting and machining steps in an in-line manner, the process from compaction to machining can be shortened.

<<Details of Embodiments of the Present Invention>>

Details of embodiments of the present invention will now be described with reference to the drawings. The present invention is not limited to the embodiments described herein, and is intended to include all changes that are described in the claims and are within the meaning and scope equivalent to those of the claims.

[First Embodiment]

A sintered body manufacturing apparatus 1 according to a first embodiment will be described with reference to FIGS. 1 to 8. The sintered body manufacturing apparatus 1 according to the first embodiment includes a compacting apparatus 2 configured to produce a green compact 20, and a machining apparatus 3 configured to perform a cutting operation on the green compact 20 to produce an unsintered material 30. A main feature of the sintered body manufacturing apparatus 1 according to the first embodiment is that it includes a green compact conveying path 5 configured to connect the compacting apparatus 2 in series to the machining apparatus 3 to sequentially convey produced green compacts 20 one by one from the compacting apparatus 2 to the machining apparatus 3. Unsintered materials 30 produced by the machining apparatus 3 are conveyed to and sintered in a sintering furnace 4. Sintered bodies (not shown) are thus manufactured. After each component of the sintered body manufacturing apparatus 1 is first described, the action of each component and the behaviors of the green compact 20 and the unsintered material 30 associated with the action will be described. Then, a sintered body manufacturing method that can use the sintered body manufacturing apparatus will be described.

[Overview]

The compacting apparatus 2 is connected in series to the machining apparatus 3 by the green compact conveying path 5 (see FIG. 1).

In the course of conveying the green compact 20 from the compacting apparatus 2 through the green compact conveying path 5 to the machining apparatus 3, and in the course of transferring the unsintered material 30 from the machining apparatus 3 to the sintering furnace 4, a plurality of transfer devices and a standby stage for temporarily keeping either of the green compact 20 and the unsintered material 30 on standby can be used. For example, a green compact transfer device 7 is disposed between the compacting apparatus 2 and the green compact conveying path 5; a conveying-side transfer device 8, a standby stage 10, and a machining-side transfer device 9 are disposed between the green compact conveying path 5 and the machining apparatus 3; the machining-side transfer device 9, the standby stage 10, the conveying-side transfer device 8, an unsintered material conveying path (or an unsintered machined compact conveying path) 6, and an unsintered material transfer device (or an unsintered machined compact transfer device) 14 are disposed between the machining apparatus 3 and the sintering furnace 4.

[Compacting Apparatus]

The compacting apparatus 2 is configured to press a raw powder containing a metal powder into the green compact 20. The compacting apparatus 2 may be a press machine that includes an appropriate compacting die assembly capable of compacting a raw powder into the final shape of a machine part.

Exemplary types of machine parts include sprockets, oil pump rotors, gears, rings, flanges, and pulleys. The machine parts (sintered bodies) each are often cylindrical in shape, with a circular bore in the center thereof. Therefore, a compacting die assembly capable of pressing in the axial direction of the cylinder is used to produce materials of cylindrical machine parts. The compacting die assembly includes, for example, upper and lower punches (not shown) having annular press surfaces for forming both end faces of the green compact 20, a columnar inner die (not shown) to be inserted into the upper and lower punches to form the inner periphery of the green compact 20, and an outer die (not shown) surrounding the outer periphery of the upper and lower punches and having a circular insertion hole for forming the outer periphery of the green compact 20. Both the end faces of the green compact 20 in the axial direction thereof are press surfaces pressed by the upper and lower punches, the inner and outer peripheries of the green compact 20 are sliding surfaces in contact with the dies, and the bore of the green compact 20 is formed integrally during compaction.

A plurality of compacting apparatuses 2 may be provided. Productivity in the manufacture of the green compacts 20 can be improved as the number of compacting apparatuses 2 increases. Two compacting apparatuses 2 (compacting die assemblies) are used here. For convenience of illustration, the compacting apparatuses 2 are simplified in FIG. 1. The illustrations of the machining apparatus 3 and the sintering furnace 4 (described below) are also simplified for the same reason.

When the production time required for one compacting apparatus 2 to produce each green compact 20 is N (seconds) and the total machining time required (for the machining apparatus 3 described below) to perform a cutting operation on each green compact 20 is M (seconds), the production time N (seconds) is normally shorter than the total machining time M (seconds). The production time N (seconds) for producing the green compact 20 may vary depending on the object to be machined, but may be less than or equal to half the total machining time M (seconds), less than or equal to one-third of the total machining time M (seconds), or less than or equal to one-sixth of the total machining time M (seconds).

[Machining Apparatus]

The machining apparatus 3 is configured to perform a cutting operation on the green compact 20 to produce the unsintered material 30. The machining apparatus 3 includes, for example, a cutting device that includes a chuck (not shown) configured to hold the green compact 20 and a cutting tool (not shown) configured to perform a desired cutting operation on the green compact 20.

When the green compact 20 is brought close to the machining apparatus 3 by the machining-side transfer device 9 (described below), the chuck receives the green compact 20 from the machining-side transfer device 9. Then, the green compact 20 is positioned to allow the cutting tool to perform a cutting operation at a predetermined location in the green compact 20.

The type of the cutting tool can be appropriately selected in accordance with the type of the machine part. A typical cutting operation performed on the machine part is hole making. The cutting tool for hole making may be a hole-making drill capable of forming a hole appropriate for the machine part. The machine part may have a through hole (e.g., used as an oil hole) passing therethrough from the outer periphery thereof to intersect (or to be orthogonal to) the bore, or may have a blind hole. The through hole or blind hole, which cannot be formed integrally with the green compact 20 during compaction, needs to be formed by the hole making operation. Other examples of the cutting tool include a turning tool, a milling cutter, and an end mill.

There may be either one or more cutting tools. When the cutting device includes a plurality of cutting tools, they may be of different sizes and types, and may be configured to be freely switchable from one to another so as to support various cutting operations. One of the plurality of cutting tools may be replaced with a positioning sensor for positioning the green compact 20.

The machining apparatus 3 is capable of having a plurality of cutting devices. As described above, since the production time N (seconds) for producing each green compact 20 is normally not equal to the total machining time M (seconds) for machining each green compact 20, it is difficult to incorporate the compacting apparatus 2 and the machining apparatus 3 into a continuous manufacturing line. This is because since the total machining time M (seconds) for machining each green compact 20 is longer than the production time N (seconds) for producing each green compact 20, the number of pre-machined green compacts 20 increases. When a plurality of cutting devices are used to perform a series of cutting operations on one green compact 20, the plurality of cutting devices required for the cutting operations are considered as one unit. By increasing the number of cutting devices per unit of the machining apparatus 3, it is possible to virtually eliminate the difference between the production time N (seconds) for producing each green compact 20 and the total machining time M (seconds) for machining each green compact 20. Specifically, the number of cutting devices per unit of the machining apparatus 3 may be M/N. Then, the green compacts 20 may be sequentially attached by the machining-side transfer device 9 to each of the cutting devices every N seconds. Thus, one unsintered material 30 is produced every N seconds by the machining apparatus 3, and the production time N (seconds) required for one compacting apparatus 2 to produce each green compact 20 and the production time required for one machining apparatus 3 (one unit) to produce each unsintered material 30 can be made equal. The compacting apparatus 2 and the machining apparatus 3 can thus be incorporated into a continuous manufacturing line.

The configuration of the plurality of cutting devices may vary depending on the type of the machine part. All the cutting devices may perform the same cutting (hole making) operation from the same side. Alternatively, some of the plurality of cutting devices may be used as first-surface machining devices 31 that perform a cutting operation from one side (first surface) of the green compact 20, whereas the other cutting devices may be used as second-surface machining devices 32 that perform a cutting operation from the other side (second surface) of the green compact 20.

A combination of the number of the first-surface machining devices 31 and the number of the second-surface machining devices 32 may be determined such that, of the first and second surfaces, one which requires more time for a cutting (hole making) operation is provided with a larger number of machining devices. Specifically, the number of the first-surface machining devices 31 and the number of the second-surface machining devices 32 may be adjusted such that the ratio between the number of the first-surface machining devices 31 and the number of the second-surface machining devices 32 is equivalent to the ratio between their machining times. For example, when the ratio of the machining time of each first-surface machining device 31 to the machining time of each second-surface machining device 32 is 2:1, two first-surface machining devices 31 and one second-surface machining device 32 may be used. This makes it possible to minimize idle time for the machining devices, achieve efficient cutting operations, and facilitate improvement in productivity. In this example, one machining apparatus 3 (one unit) includes two first-surface machining devices 31 and one second-surface machining device 32. The two first-surface machining devices 31 are arranged right and left, parallel to each other, on the upstream side of the machining-side transfer device 9, whereas the second-surface machining device 32 is disposed on the downstream side of the machining-side transfer device 9 to face the first-surface machining devices 31.

There may be a plurality of machining apparatuses 3. Productivity can be improved as the number of machining apparatuses 3 increases. Two machining apparatuses 3 (two units) are provided here, and are arranged along and parallel to the green compact conveying path 5.

The green compacts 20 are attached to each machining apparatus 3 by the machining-side transfer device 9 such that one unsintered material 30 is produced every production time required for one compacting apparatus 2 to produce each green compact 20. That is, when one green compact 20 is produced every N seconds by one compacting apparatus 2 and one machining apparatus 3 (one unit) includes two first-surface machining devices 31 and one second-surface machining device 32, the green compacts 20 are sequentially attached to the two first-surface machining devices 31 every N seconds by the machining-side transfer device 9. In this example, one green compact 20 is produced every N/2 seconds by two compacting apparatuses 2, each configured to produce one green compact 20 every N seconds. In this case, when there are two machining apparatuses 3 (two units), each including two first-surface machining devices 31 and one second-surface machining device 32, and the green compacts 20 are sequentially attached to the respective machining apparatuses 3 every N/2 seconds, one green compact 20 can be attached to one of the first-surface machining devices 31 of each machining apparatus 3 every N seconds. Thus, even when the production time for producing each green compact 20 is not equal to the total machining time for machining each green compact 20, the compacting apparatuses 2 and the machining apparatuses 3 can be incorporated into a continuous manufacturing line.

[Sintering Furnace]

The sintering furnace 4 is configured to sinter the unsintered material 30. A sintered body is produced by the sintering. The sintering furnace 4 is not particularly limited, as long as it is capable of heating the unsintered material 30 to a temperature at which the unsintered material 30 can be sintered. For example, a mesh-belt continuous furnace may be used as the sintering furnace 4. The sintering furnace 4 is disposed substantially parallel to the conveying paths 5 and 6 at a location opposite the machining apparatus 3, with the conveying paths 5 and 6 interposed therebetween. The entrance to the sintering furnace 4 is on the upstream side of the green compact conveying path 5 (i.e., adjacent to the compacting apparatus 2), and the exit from the sintering furnace 4 is on the downstream side of the green compact conveying path 5.

[Conveying Paths]

(Green Compact Conveying Path)

The green compact conveying path 5 is configured to connect the compacting apparatus 2 in series to the machining apparatus 3 to continuously convey the green compacts 20 one by one from the compacting apparatus 2 to the machining apparatus 3. The green compact conveying path 5 runs at a constant speed to convey the green compacts 20 to the machining apparatus 3. For example, a conveyor belt may be used as the green compact conveying path 5.

(Unsintered Material Conveying Path)

The unsintered materials 30 produced by the machining apparatus 3 are conveyed toward the compacting apparatus 2 by the unsintered material conveying path 6 which extends adjacent and parallel to the green compact conveying path 5 from the machining apparatus 3 toward the compacting apparatus 2. The unsintered material conveying path 6 runs at a constant speed equal to that of the green compact conveying path 5. Like the green compact conveying path 5, for example, a conveyor belt may be used as the unsintered material conveying path 6.

The green compact conveying path 5 and the unsintered material conveying path 6 may run independent of each other. Alternatively, the downstream end of the unsintered material conveying path 6 may communicate with the upstream end of the green compact conveying path 5 on the side adjacent to the compacting apparatus 2. That is, the green compact conveying path 5 and the unsintered material conveying path 6 may serve as a forward path and a return path, respectively, to form a continuous conveying path. As will be described in detail below, this facilitates reuse of trays 100 (described below) used to hold and convey the green compacts 20. This is because when each tray 100 holding one unsintered material 30 thereon is conveyed to a predetermined position on the unsintered material conveying path 6 and then, after transfer of the unsintered material 30 to the sintering furnace 4, the tray 100 alone is further conveyed from the predetermined position to the compacting apparatus 2, the next green compact 20 can be loaded on the same tray 100 and conveyed toward the machining apparatus 3. It is thus possible to minimize the number of trays 100.

[Tray]

The trays 100, each capable of holding either the green compact 20 or the unsintered material 30 thereon, can be used to convey the green compacts 20 and the unsintered materials 30 on the green compact conveying path 5 and the unsintered material conveying path 6. That is, the trays 100 are conveyed on the conveying paths 5 and 6. Using the trays 100 facilitates reduction of damage to the green compacts 20 and the unsintered materials 30. This is because using the trays 100 can reduce contact of the green compacts 20 and the unsintered materials 30 with the edges of the green compact conveying path 5 and the unsintered material conveying path 6.

Each tray 100 is preferably provided with an IC tag (not shown) that stores the route of conveyance of the tray 100. This enables identification of the positional information of the tray 100. Even when there are a plurality of machining apparatuses 3 (units), it is possible to easily identify when the tray 100 was conveyed to which machining apparatus 3.

Each tray 100 may have a size that is large enough to accommodate either of the green compact 20 and the unsintered material 30.

A loading surface of the tray 100 for holding either of the green compact 20 and the unsintered material 30 thereon is preferably provided with a positioning portion (not shown) for positioning either of them. This can reduce displacement of the green compact 20 and the unsintered material 30 in the course of conveyance, and reduce damage caused by collision of either of the green compact 20 and the unsintered material 30 with the edge of the conveying path resulting from the displacement. The surface of the green compact 20 placed on the loading surface of the tray 100 differs from that of the unsintered material 30. Therefore, the positioning portion described above needs to accommodate either of them. For example, the positioning portion may be formed by appropriately combining a peripheral wall surrounding at least part of the outer periphery of either of the green compact 20 and the unsintered material 30 and, when the green compact 20 and the unsintered material 30 each have a bore or other hole, a protrusion to be inserted into the hole. The surface of the tray 100 opposite the loading surface thereof is preferably provided with a notch (not shown) that allows a retainer 81 of the conveying-side transfer device 8 (described below) to easily hold the tray 100.

The green compact transfer device 7 transfers the green compact 20 from the compacting apparatus 2 onto the tray 100.

The conveying-side transfer device 8 raises the tray 100 from the green compact conveying path 5 to transfer the green compact 20 to the machining apparatus 3, and transfers the tray 100 to the unsintered material conveying path 6.

[Green Compact Transfer Device]

The green compact transfer device 7 is capable of transferring the green compact 20 produced by the compacting apparatus 2 from an initial position to a predetermined position (i.e., onto the tray 100 on the green compact conveying path 5). Normally, the green compact 20 is taken out of the compacting die assembly and temporarily conveyed by a conveyor belt or the like to a specific location. That is, this specific location is the initial position described above.

Figure 2:
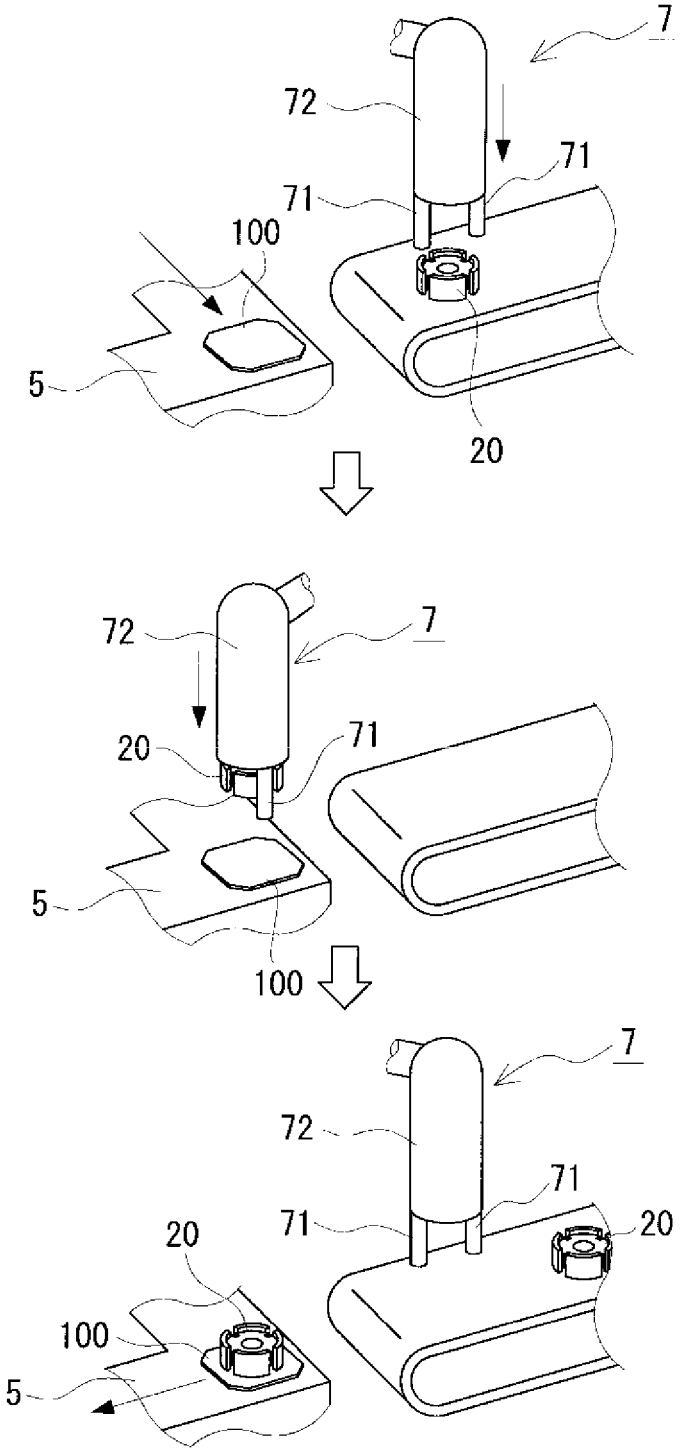
FIG. 2 is a process diagram illustrating a procedure through which a green compact transfer device included in the sintered body manufacturing apparatus of the first embodiment operates.

As illustrated in FIG. 2, the green compact transfer device 7 may include a retainer 71 configured to hold and place the green compact 20, and an arm 72 connected to the retainer 71 and configured to transfer the green compact 20 held by the retainer 71 from the initial position to the predetermined position (i.e., onto the tray 100). This configuration is also applicable to the unsintered material transfer device 14 described below.

The retainer 71 that holds the green compact 20 may be an electromagnet or vacuum pad that attracts the green compact 20, or may be a manipulator, such as a robot hand, that grasps the green compact 20.

In the case of grasping, the retainer 71 may grasp the outer periphery of the green compact 20 with a force exerted from the outside toward the inside of the green compact 20, or the retainer 71 may be inserted into the bore of the green compact 20 (if the green compact 20 has the bore) to grasp the inner periphery of the green compact 20 with a force exerted from the inside toward the outside. The same is applicable to retainers 91 included in the machining-side transfer device 9.

In this example, the retainer 71 is formed by a robot hand capable of being driven to open and close, and is configured to grasp the outer periphery of the green compact 20. The robot hand is driven to open and close by an actuator (not shown) including a motor and a circuit configured to output a command from a retainer control unit of a green compact transfer controller (described below) to the motor. As in driving the robot hand, driving the arm 72 of the green compact transfer device 7, driving the retainer 81 and a slide mechanism 82 of the conveying-side transfer device 8, driving and switching (rotating) each retainer 91 of the machining-side transfer device 9, and driving an arm 92 of the machining-side transfer device 9 (all of these components are described below) can each be done, for example, by an actuator including a motor and a circuit, though the controller varies depending on the component.

The green compact transfer controller is included in a computer, which controls the green compact transfer device 7. The same is applicable to a conveying-side transfer controller and a machining-side transfer controller (described below).

The arm 72 is configured to be capable of being freely driven up and down and right to left. Specifically, the arm 72 is configured to move downward to bring the retainer 71 close to the green compact 20, transfer the green compact 20 from the initial position to the predetermined position (from right to left in FIG. 2), move upward to bring the retainer 71 away from the green compact 20 after the retainer 71 places the green compact 20, and return from the predetermined position to the initial position (from left to right in FIG. 2).

Although only one green compact transfer device 7 is provided for two compacting apparatuses 2 here, each of the compacting apparatuses 2 may be provided with one green compact transfer device 7.

It is preferable to provide a stopper (not shown) or the like that restricts, when the green compact transfer device 7 transfers the green compact 20 to the tray 100 on the green compact conveying path 5, the travel of the tray 100 to prevent the tray 100 from moving on the green compact conveying path 5. Alternatively, a stage similar to the standby stage 10 (described below) may be additionally provided and, before the green compact 20 is placed onto the tray 100, the tray 100 may be moved from the green compact conveying path 5 onto the stage and temporarily kept on standby thereon. Although there is no need to provide a stopper in this case, a transfer device similar to the conveying-side transfer device 8 (described below) may be provided. Then, the transfer device transfers the tray 100 from the stage to the green compact conveying path 5. The same applies to the unsintered material transfer device 14 (described below).

[Standby Stage]

It is preferable to provide the standby stage 10 configured to temporarily keep the green compact 20 on standby thereon before the green compact 20 on the green compact conveying path 5 is moved to the machining apparatus 3, and temporarily keep the unsintered material 30 on standby thereon before the unsintered material 30 on the machining apparatus 3 is transferred to the sintering furnace 4 (i.e., before the unsintered material 30 on the machining apparatus 3 is placed onto the unsintered material conveying path 6 here). This facilitates replacement of the green compact 20 to be attached to the machining apparatus 3 with the unsintered material 30 taken out of the machining apparatus 3, as will be described in detail below in the description of operation.

The standby stage 10 may be installed between the green compact conveying path 5 and the machining apparatus 3. The standby stage 10 may have a size that is large enough to hold one tray 100 (green compact 20) thereon. This is because the standby stage 10 is not intended to store green compacts 20 thereon, but is intended to allow the machining-side transfer device 9 to easily hold and place either of the green compact 20 and the unsintered material 30. One standby stage 10 is provided for each machining apparatus 3 (one unit). The same applies to the conveying-side transfer device 8 and the machining-side transfer device 9.

A loading surface of the standby stage 10 for holding the tray 100 thereon preferably has a holding portion (not shown) configured to grasp opposite edges of the tray 100 to restrict the movement of the tray 100. This facilitates reduction of displacement of the tray 100, and allows the machining-side transfer device 9 to easily hold the green compact 20.

[Conveying-Side Transfer Device]

Figure 3:
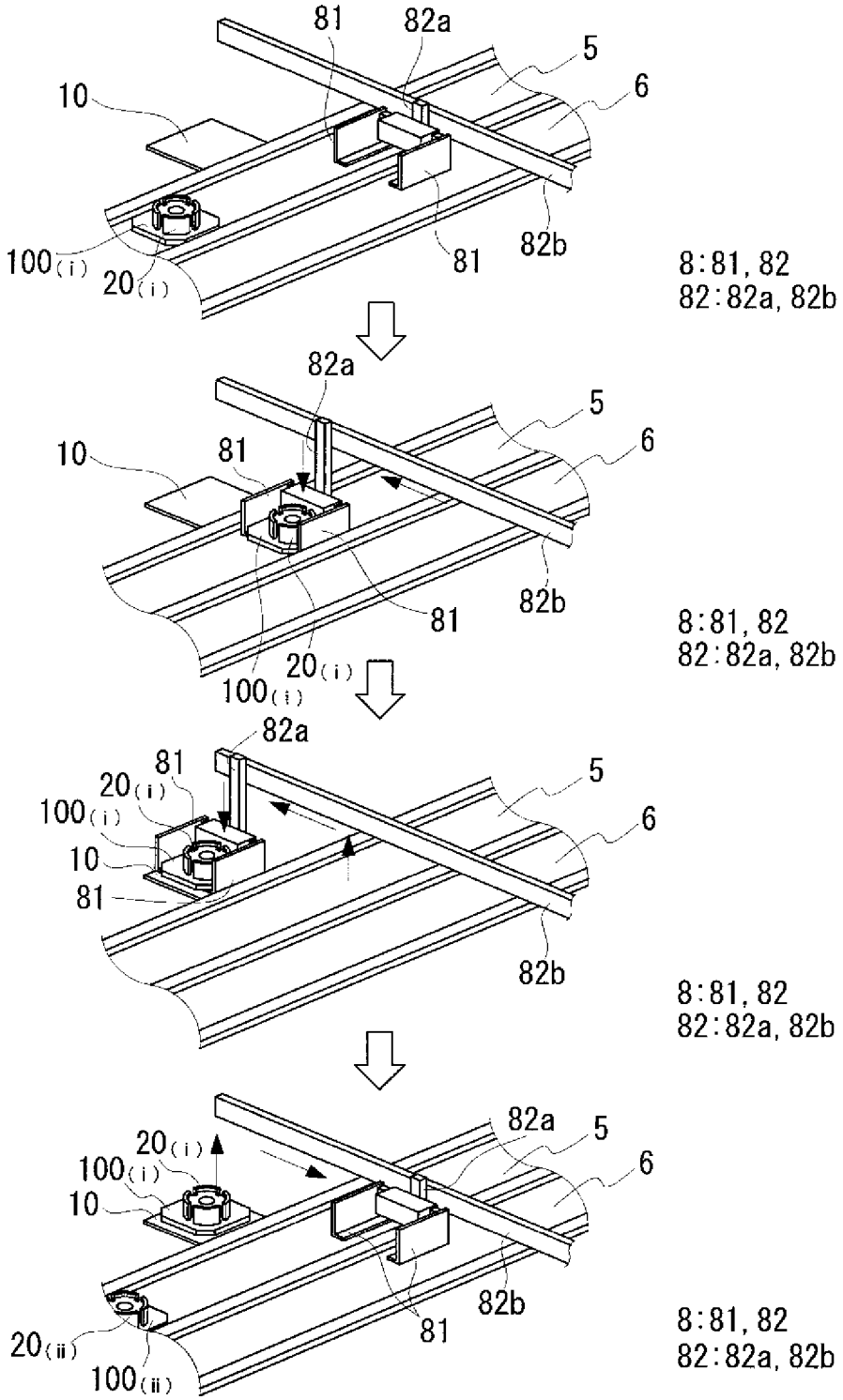
FIG. 3 is a process diagram illustrating a procedure through which a conveying-side transfer device included in the sintered body manufacturing apparatus of the first embodiment transfers a green compact from a green compact conveying path to a standby stage.
Figure 4:
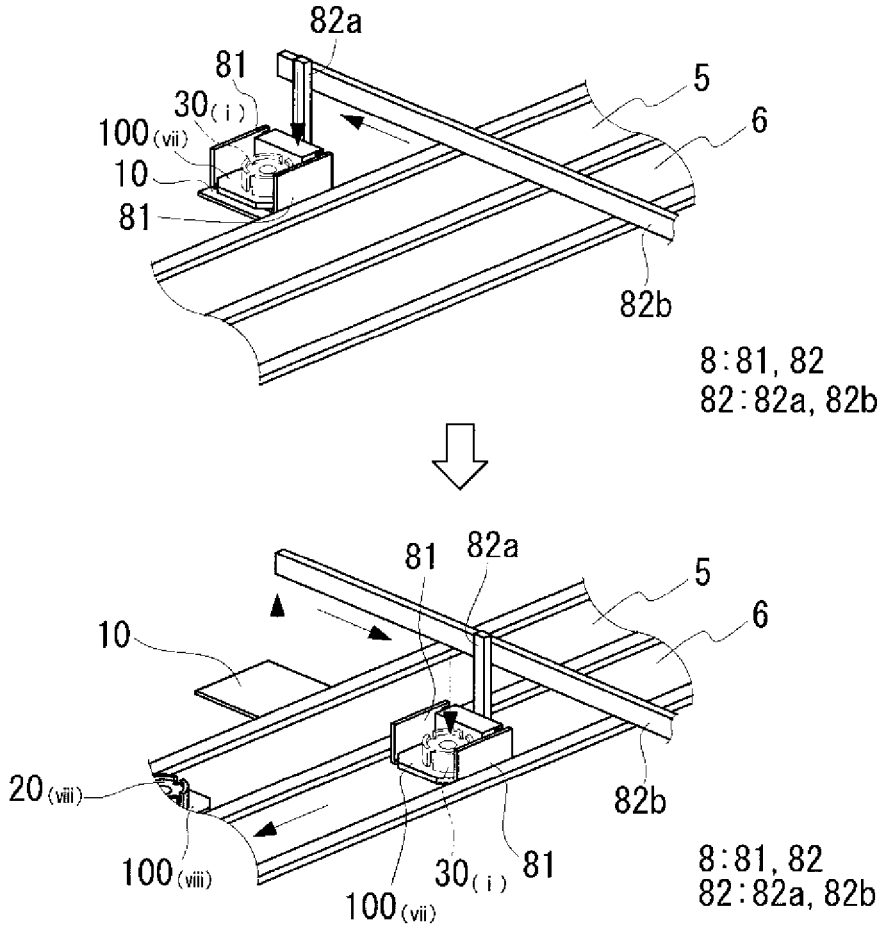
FIG. 4 is a process diagram illustrating a procedure through which the conveying-side transfer device included in the sintered body manufacturing apparatus of the first embodiment transfers a green compact from the standby stage to an unsintered material conveying path.

The conveying-side transfer device 8 may be provided, which is configured to hold and transfer the green compact 20 on the green compact conveying path 5 to the standby stage 10, and hold and transfer the unsintered material 30 on the standby stage 10 to the sintering furnace 4 (see FIGS. 3 and 4). FIGS. 3 and 4 show the conveying-side transfer device 8 on the upstream side, and does not show the machining-side transfer device 9 for convenience of illustration. Here, the conveying-side transfer device 8 transfers the green compact 20 to the standby stage 10 together with the tray 100, and transfers the unsintered material 30 to the unsintered material conveying path 6 together with the tray 100.

The conveying-side transfer device 8 may include, for example, the retainer 81 configured to hold and place either of the green compact 20 and the unsintered material 30, and the slide mechanism 82 connected to the retainer 81 and configured to slide the retainer 81 up and down and right to left. The retainer 81 is configured to open and close outside the tray 100 to grasp and place the tray 100.

The slide mechanism 82 includes a vertical slide portion 82*a* configured to raise and lower the retainer 81, and a horizontal slide portion 82*b* configured to horizontally move the retainer 81 in the right and left direction. The right and left direction is a direction along which the green compact conveying path 5 and the unsintered material conveying path 6 are arranged side by side. The vertical slide portion 82*a* lowers the retainer 81 to bring the retainer 81 close to the green compact 20 (tray 100), or to place the green compact 20 (tray 100) onto the standby stage 10 or the unsintered material conveying path 6. Also, the vertical slide portion 82*a* raises the retainer 81 to move the green compact 20 (tray 100) upward, or to move the retainer 81 away from the green compact 20 (tray 100). The horizontal slide portion 82*b* horizontally moves in the right and left direction to bring the retainer 81 above any of the standby stage 10, the green compact conveying path 5, and the unsintered material conveying path 6.

[Machining-Side Transfer Device]

Figure 5:
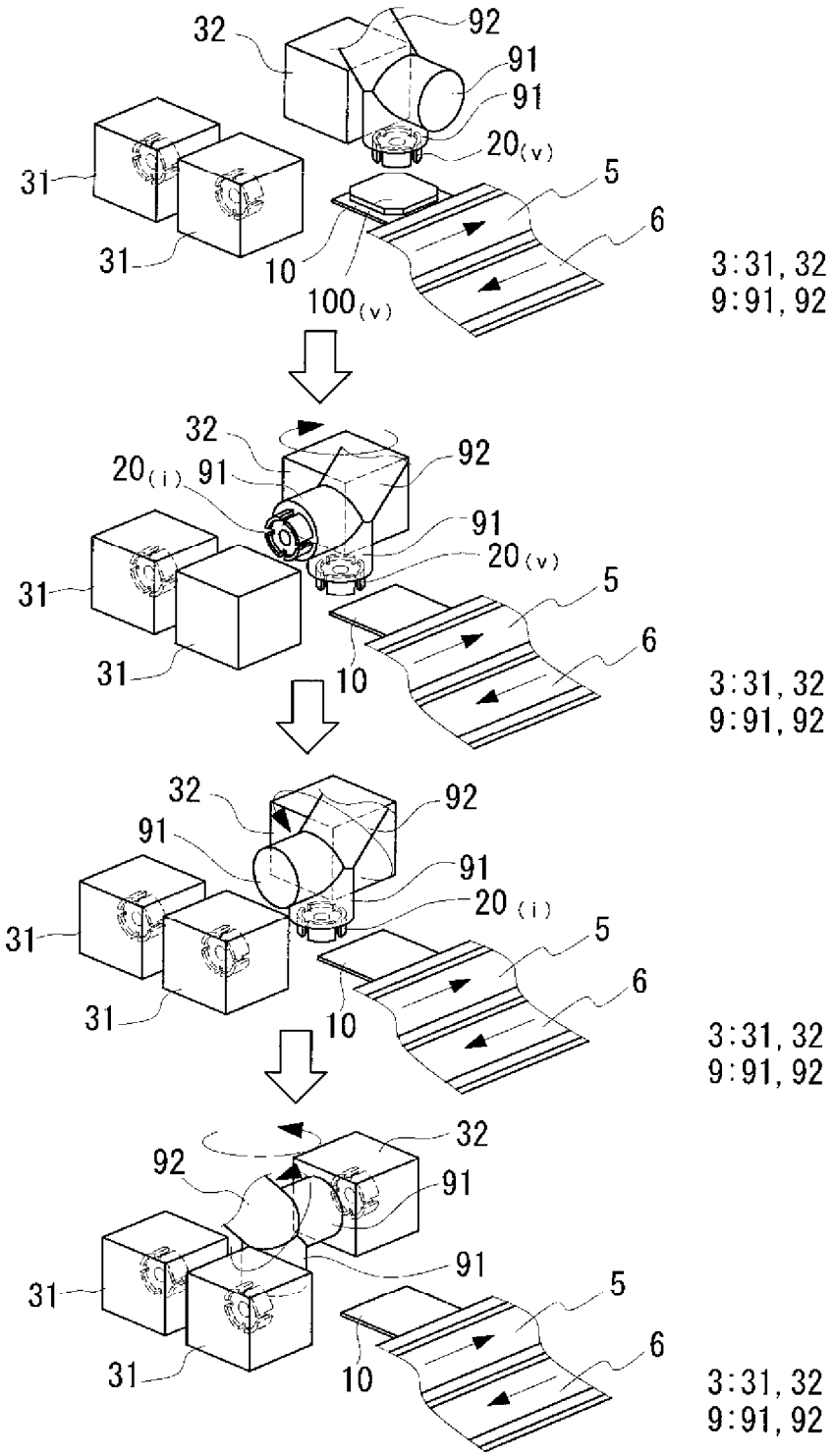
FIG. 5 is a process diagram illustrating a procedure through which a machining-side transfer device included in the sintered body manufacturing apparatus of the first embodiment replaces a green compact with another.
Figure 6:
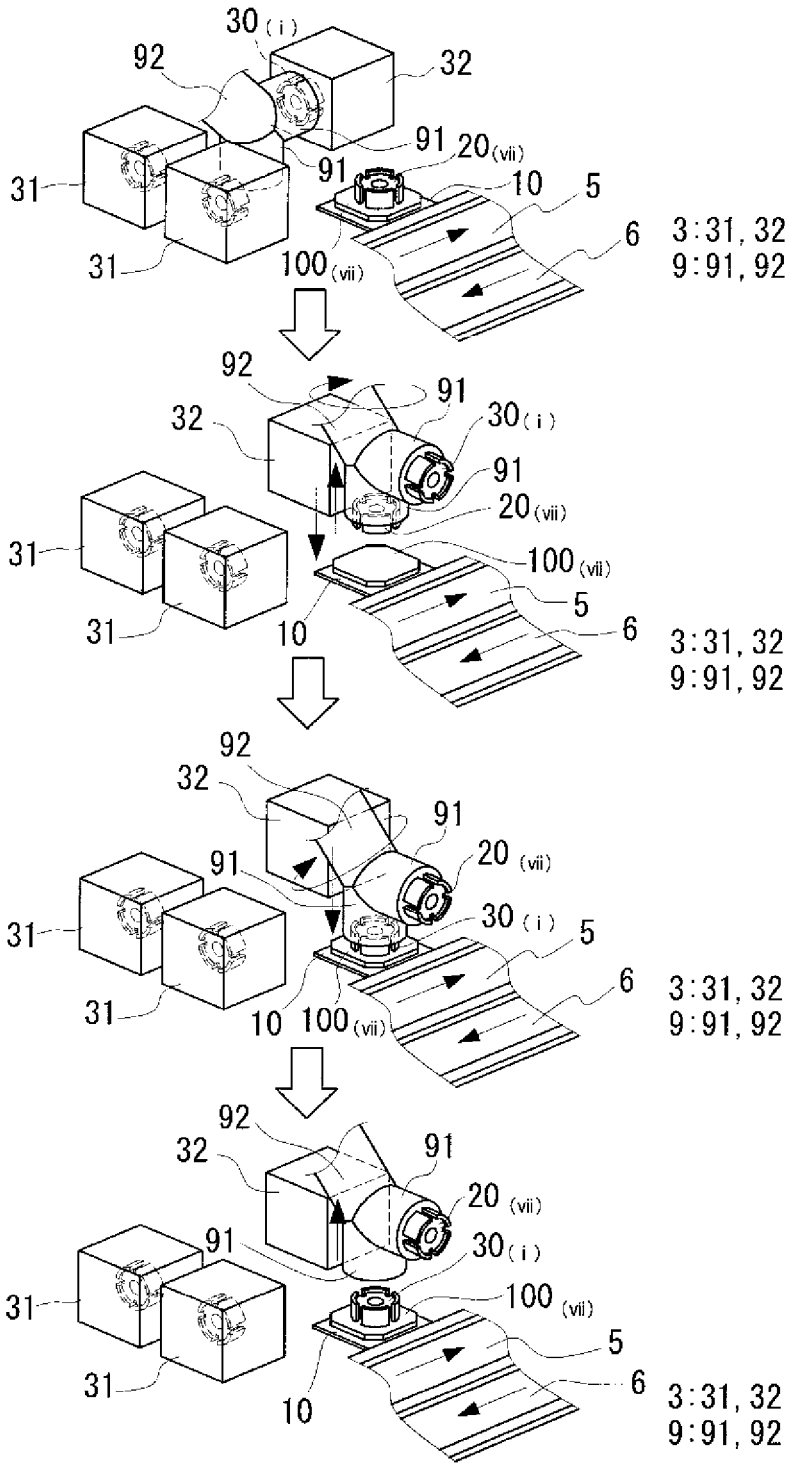
FIG. 6 is a process diagram illustrating a procedure through which the machining-side transfer device included in the sintered body manufacturing apparatus of the first embodiment replaces a green compact with an unsintered material.

The machining-side transfer device 9 can be used to hold the green compact 20 on the standby stage 10 and attach it to the machining apparatus 3, and to remove the unsintered material 30 from the machining apparatus 3 and place it onto the standby stage 10 (see FIGS. 5 and 6). FIGS. 5 and 6 show the machining-side transfer device 9 on the upstream side, and does not show the conveying-side transfer device 8 for convenience of illustration.

The machining-side transfer device 9 includes two retainers 91 each configured to hold and release either of the green compact 20 and the unsintered material 30, and the arm 92 connected to the retainers 91 and configured to move the retainers 91 between the standby stage 10 and the machining apparatus 3. In FIGS. 5 and 6, the retainers 91 are simplified for convenience of illustration. Both the retainers 91 are connected to an end of the arm 92 such that they revolve together about the axis of the arm 92. The retainers 91 are each freely switchable between holding and releasing the green compact 20 and between holding and releasing the unsintered material 30. The arm 92 is configured to move the retainers 91 between the standby stage 10, either of the first-surface machining devices 31, and the second-surface machining device 32.

Each of the retainers 91 may be configured similarly to the retainer 71 of the green compact transfer device 7 described above. The retainer 91 is configured to hold the green compact 20 on the standby stage 10, attach the held green compact 20 to one of the first-surface machining devices 31, remove the green compact 20 from the first-surface machining device 31, attach the green compact 20 removed from the first-surface machining device 31 to the second-surface machining device 32, remove the unsintered material 30 from the second-surface machining device 32, and place the unsintered material 30 removed from the second-surface machining device 32 onto the standby stage 10.

As in the case of the green compact transfer device 7, the arm 92 is configured to be capable of being freely driven up and down and right to left, between each first-surface machining device 31 and the second-surface machining device 32. Specifically, the arm 92 is configured to move downward to bring one of the retainers 91 close to the standby stage 10, move upward and rotate to bring the retainer 91 close to one of the first-surface machining devices 31, and rotate to move the retainer 91 from the first-surface machining device 31 toward the second-surface machining device 32.

[Marking Apparatus]

A marking apparatus 13 is preferably provided (see FIG. 1), which is configured to provide a marking for identifying a machining history of each unsintered material 30. For example, the machining history indicates when the unsintered material 30 was machined by which machining apparatus 3 (cutting device). That is, with the marking apparatus 13, when a plurality of machining apparatuses 3 are provided and each machining apparatus 3 includes a plurality of cutting devices as described above, simply checking the marking makes it possible to identify when the unsintered material 30 was machined by what type of cutting device in which machining apparatus 3.

The marking is not limited to a particular type as long as the machining history is not removed during sintering. The type of the marking may be, for example, a barcode (e.g., two-dimensional barcode). A commercially-available laser marking apparatus may be used as the marking apparatus 13.

The marking apparatus 13 may be installed between the machining apparatus 3 and the sintering furnace 4. More specifically, the marking apparatus 13 may be installed between the unsintered material conveying path 6 and the sintering furnace 4, independently of the unsintered material conveying path 6.

[Unsintered Material Conveying Path]

The unsintered material transfer device 14 may be provided (see FIG. 1), which is configured to transfer the unsintered material 30 on the unsintered material conveying path 6 to the marking apparatus 13. As described above, when the downstream end of the unsintered material conveying path 6 is connected to the upstream end of the green compact conveying path 5, the unsintered material transfer device 14 can transfer only the unsintered material 30, with the tray 100 left on the unsintered material conveying path 6. The tray 100 can thus be conveyed to the compacting apparatus 2 and used again to hold and convey the next green compact 20 to the machining apparatus 3. The unsintered material transfer device 14 may include a retainer and an arm (not shown) similar to those of the green compact transfer device 7 described above.

The configuration of the unsintered material transfer device 14 may vary depending on the positional relationship (or distance) between the marking apparatus 13 and the sintering furnace 4. The unsintered material transfer device 14 may be configured not only to transfer the unsintered material 30 to the marking apparatus 13, but also to transfer the unsintered material 30 having a marking thereon from the marking apparatus 13 to the sintering furnace 4.

Aside from the unsintered material transfer device 14, another transfer device configured to transfer the unsintered material 30 having a marking thereon to the sintering furnace 4 may of course be provided.

[Green Compact Transfer Controller]

With reference to the process diagram of FIG. 2, a procedure through which the green compact transfer controller controls the green compact transfer device 7 will be described. A filled arrow in FIG. 2 indicates the movement of each component. This also applies to FIGS. 3 to 6 (described below). The green compact transfer controller is configured to cause the green compact transfer device 7 to repeat a series of actions involving holding, transferring, and placing each green compact 20 so as to move the green compacts 20 one by one from the initial position to the predetermined position (i.e., onto the tray 100 on the green compact conveying path 5).

The green compact transfer controller includes an input unit, a memory, a retainer control unit, and an arm drive control unit. The input unit is configured to input setting data to be stored in the memory. The memory is configured to store the setting data, such as positional information of the transfer origin and destination of each green compact 20. The retainer control unit is configured to control the holding and positioning of the green compact 20 performed by the retainer 71. The arm drive control unit is configured to control the transfer of the arm 72 from the initial position to the predetermined position and the return of the arm 72 from the predetermined position to the initial position.

First, the setting data is read, which is the positional information of the transfer origin required for driving the arm 72 and the positional information of the transfer destination at which the green compact 20 is to be placed. When the green compact 20 produced by one of the compacting apparatuses 2 (see FIG. 1) is conveyed by the conveyor belt to the position of the transfer origin (see the upper part of FIG. 2) while the arm 72 is at the position of the transfer origin, the arm drive control unit lowers the arm 72 to cause the retainer 71 to be positioned outside the green compact 20. Then, the retainer control unit closes the retainer 71 to cause the retainer 71 to grasp the outer periphery of the green compact 20.

After raising the arm 72 and transferring the arm 72 from the position of the transfer origin to the position of the transfer destination on the basis of the positional information of the transfer destination of the green compact 20 in the setting data stored in advance (see the middle part of FIG. 2), the arm drive control unit lowers the arm 72 to bring the retainer 71 close to the tray 100. Next, the retainer control unit causes the retainer 71 to release the green compact 20, and thereby allows the green compact 20 to be placed onto the tray 100. At this point, the stopper (not shown) may restrict the travel of the tray 100 on the green compact conveying path 5. Although the green compact conveying path 5 keeps running continuously, the tray 100 slides on the green compact conveying path 5 by being retained by the stopper, and is held at a predetermined position on the green compact conveying path 5.

Then, the arm drive control unit raises the arm 72 and returns the arm 72 from the position of the transfer destination to the position of the transfer origin (see the lower part of FIG. 2).

The tray 100 having the green compact 20 thereon is conveyed by the green compact conveying path 5 toward the machining apparatus 3 (see the lower part of FIG. 2). Then, the next tray 100 is prepared, and the green compact transfer controller repeats the control of the green compact transfer device 7.

The green compact transfer controller may control the green compact transfer device 7 in accordance with the production time required for the compacting apparatus 2 to produce each green compact 20. That is, when the production time required for one compacting apparatus 2 to produce each green compact 20 is N seconds, the green compact transfer controller controls the green compact transfer device 7 such that one green compact 20 is transferred every N seconds. This allows one green compact 20 to be conveyed each time one green compact 20 is produced. Since one green compact transfer device 7 is used for two compacting apparatuses 2 here, the green compact transfer controller controls the green compact transfer device 7 such that one green compact 20 is transferred every N/2 seconds.

[Conveying-Side Transfer Controller]

With reference to the process diagrams of FIGS. 3 and 4, a procedure through which the conveying-side transfer controller controls the conveying-side transfer device 8 will be described. For convenience of illustration, the green compacts 20 and the trays 100 in FIGS. 3 and 4 and the unsintered material 30 in FIG. 4 are each identified by a Roman numeral subscript in brackets. The Roman numerals each indicate a number for each of the green compacts 20, the trays 100, and the unsintered material 30. This also applies to FIGS. 5 and 6 (described below).

FIG. 3 illustrates how the conveying-side transfer device 8 moves the green compact 20 (tray 100) from the green compact conveying path 5 to the standby stage 10. FIG. 4 illustrates how the conveying-side transfer device 8 moves the unsintered material 30 (tray 100) from the standby stage 10 to the unsintered material conveying path 6.

The conveying-side transfer controller causes the conveying-side transfer device 8 to repeat the transfer of the tray 100 from the green compact conveying path 5 onto the standby stage 10 and the transfer of the tray 100 from the standby stage 10 to the unsintered material conveying path 6. The conveying-side transfer controller includes an input unit, a memory, a sensor, a counter, a retainer control unit, and a slide drive control unit.

The input unit is configured to input setting data to be stored in the memory. The memory is configured to store the setting data, such as positional information of the transfer origin and destination of each green compact 20 (tray 100). The sensor is configured to detect the green compact 20 passing through a predetermined position on the green compact conveying path 5. The counter is configured to count the number of green compacts 20 that have passed, on the basis of the result of the detection made by the sensor.

The retainer control unit and the slide drive control unit are configured to control whether to hold and place the green compact 20 (tray 100) on the basis of the count value. Specifically, the retainer control unit is configured to control the action of holding and placing the green compact 20 (tray 100) performed by the retainer 81. The slide drive control unit is configured to control the downward and upward movement of the vertical slide portion 82*a*, and to also control the transfer movement of the horizontal slide portion 82*b* from the initial position (above the unsintered material conveying path 6) to the position of the transfer origin, the transfer movement of the horizontal slide portion 82*b* from the position of the transfer origin to a transfer destination, and the return movement of the horizontal slide portion 82*b* from the position of the transfer destination to the initial position. Examples of the combination of the transfer origin and the transfer destination include the combination of the green compact conveying path 5 and the standby stage 10, and the combination of the standby stage 10 and the unsintered material conveying path 6.

When, for example, a plurality of machining apparatuses 3 are provided as in the present example, the retainer control unit and the slide drive control unit may perform the same control on all the conveying-side transfer devices 8 corresponding to the respective machining apparatuses 3. Alternatively, the retainer control unit and the slide drive control unit may control the conveying-side transfer device 8 corresponding to the machining apparatus 3 on the most downstream side such that the conveying-side transfer device 8 holds and places every green compact 20 (tray 100) regardless of the count value.

For example, when there are two machining apparatuses 3 (two units) as in the present example, the retainer control unit and the slide drive control unit control the conveying-side transfer devices 8 corresponding to the respective machining apparatuses 3 on the upstream and downstream sides in the following manner.

The retainer control unit and the slide drive control unit control the conveying-side transfer device 8 on the upstream side such that if the green compact 20 to be conveyed is an odd-numbered one, the conveying-side transfer device 8 grasps the tray 100 having the green compact 20 thereon.

This means that if the green compact 20 to be conveyed is an even-numbered one, the green compact 20 is conveyed toward the downstream side without being grasped. The retainer control unit and the slide drive control unit control the conveying-side transfer device 8 on the downstream side such that the conveying-side transfer device 8 grasps every tray 100 (green compact 20). That is, the odd-numbered green compacts 20 are transferred to the machining apparatus 3 on the upstream side, and the even-numbered green compacts 20 are transferred to the machining apparatus 3 on the downstream side.

For example, when there are three machining apparatuses 3 (three units), the retainer control unit and the slide drive control unit control the conveying-side transfer devices 8 corresponding to the respective machining apparatuses 3 (units) at the upstream, midstream, and downstream positions in the following manner. The retainer control unit and the slide drive control unit control the conveying-side transfer device 8 at the most upstream position such that if "a remainder obtained by dividing, by the number of units, the count value n of the green compact 20 to be conveyed is 1", that is, if the green compact 20 to be conveyed is any of the first one, fourth one, seventh one, and so on (i.e., n=1, 4, 7, etc.), the conveying-side transfer device 8 grasps the tray 100 having the green compact 20 thereon. The other trays 100 are conveyed toward the downstream side without being grasped by the conveying-side transfer device 8. The retainer control unit and the slide drive control unit control the conveying-side transfer device 8 at the midstream position such that if "the remainder described above is 2", that is, if the green compact 20 to be conveyed is any of the second one, fifth one, eighth one, and so on (i.e., n=2, 5, 8, etc.), the conveying-side transfer device 8 grasps the tray 100 having the green compact 20 thereon. If "the remainder described above is 0", that is, if the green compact 20 to be conveyed is any of the third one, sixth one, ninth one, and so on (i.e., n=3, 6, 9, etc.), the tray 100 having the green compact 20 thereon is conveyed toward the downstream side without being grasped. The retainer control unit and the slide drive control unit control the conveying-side transfer device 8 at the downstream position such that the conveying-side transfer device 8 grasps every tray 100 (green compact 20).

Actions performed by the retainer 81 and the slide mechanism 82 under control of the retainer control unit and the slide drive control unit will now be described in detail. First, the settings of the positional information of the transfer origin required for driving the slide mechanism 82 and the positional information of the transfer destination at which the green compact 20 is to be placed are read. Next, the sensor detects the tray 100 (see the upper part of FIG. 3) conveyed to a predetermined position by the green compact conveying path 5, and the counter counts the number of green compacts 20.

If the count value is an odd number, that is, if the green compact 20 is an odd-numbered one which is to be held, the slide drive control unit horizontally moves the horizontal slide portion 82*b* from the initial position to above the green compact conveying path 5 (see the upper middle part of FIG. 3). Next, the slide drive control unit lowers the vertical slide portion 82*a* to cause the retainer 81 to be positioned outside the tray 100 (odd-numbered one). Next, the retainer control unit closes the retainer 81 to cause the retainer 81 to grasp the outer periphery of the tray 100. Next, the slide drive control unit raises the vertical slide portion 82*a*, moves the horizontal slide portion 82*b* horizontally from above the green compact conveying path 5 to above the standby stage 10, and lowers the vertical slide portion 82*a* to bring the retainer 81 close to the standby stage 10. Next, the retainer control unit opens the retainer 81 to release the tray 100, and thereby allows the tray 100 to be placed onto the standby stage 10 (see the lower middle part of FIG. 3).

Then, the slide drive control unit raises the vertical slide portion 82*a* and moves the horizontal slide portion 82*b* horizontally from above the standby stage 10 to the initial position above the unsintered material conveying path 6 (see the lower part of FIG. 3).

If the count value is an even (or odd) number, that is, if the green compact 20 is an even-numbered (or odd-numbered) one which is not to be held, the retainer control unit and the slide drive control unit allow the tray 100 (even-numbered one) to be conveyed to the machining apparatus 3 on the downstream side and do nothing that causes the retainer 81 and the slide mechanism 82 to operate. The conveying-side transfer device on the downstream side transfers every conveyed tray 100 to the standby stage 10. This transfer action is performed by controlling the slide mechanism and the retainer on the downstream side, as in the case of the slide mechanism 82 and the retainer 81 on the upstream side described above.

After the green compact 20 (any of the first to third green compacts) on the tray 100 on the standby stage 10 is held by the machining-side transfer device 9, or the green compact 20 on the tray 100 is replaced on the standby stage 10 with the unsintered material 30 (indicated by a two-dot chain line in the upper part of FIG. 4) on the machining apparatus 3 and the unsintered material 30 is placed on the tray 100 (i.e., the green compact is the fourth or further one), the slide drive control unit moves the horizontal slide portion 82*b* horizontally from the initial position to above the standby stage 10 (see the upper part of FIG. 4). Next, the slide drive control unit lowers the vertical slide portion 82*a* to cause the retainer 81 to be positioned outside the tray 100 on the standby stage 10. Then, the retainer control unit closes the retainer 81 to cause the retainer 81 to grasp the outer periphery of the tray 100.

Next, the slide drive control unit raises the vertical slide portion 82*a*, moves the horizontal slide portion 82*b* horizontally from above the standby stage 10 to above the unsintered material conveying path 6, and lowers the vertical slide portion 82*a* to bring the retainer 81 close to the unsintered material conveying path 6 (see the lower part of FIG. 4).

Next, the retainer control unit opens the retainer 81 to release the tray 100, and thereby allows the tray 100 to be placed onto the unsintered material conveying path 6.

The tray 100 alone (i.e., the tray 100 not having the unsintered material 30 thereon) or the tray 100 having the unsintered material 30 thereon is conveyed by the unsintered material conveying path 6 toward the compacting apparatus 2. The slide drive control unit raises the vertical slide portion 82*a* and returns it to the initial position (see the upper part of FIG. 3).

It is preferable to provide a stopper (not shown) or the like that retains, when the conveying-side transfer device 8 holds the tray 100 on the green compact conveying path 5, the position of the tray 100 on the green compact conveying path 5 without restricting the travel of the green compact conveying path 5. When the stopper temporarily keeps the tray 100 on standby on the green compact conveying path 5, the green compact 20 (tray 100) can be easily held by the retainer 81. The stopper may be provided on the edge of the green compact conveying path 5, or may be included in the retainer 81 so that the retainer 81 also serves as the stopper. When the retainer 81 also serves as the stopper, the retainer 81 is kept on standby on the green compact conveying path 5 in advance after the sensor detects the green compact 20. Then, when the tray 100 reaches the inside of the retainer 81, the travel of the tray 100 is temporarily restricted inside the retainer 81. The retainer 81 can easily grasp the tray 100 when grasping the tray 100 after the travel of the tray 100 is restricted. To keep the retainer 81 on standby on the green compact conveying path 5, it is only necessary to compute the timing of when the tray 100 will arrive at the position (transfer origin) where the tray 100 will be grasped. For example, the timing may be computed from the conveying speed of the green compact conveying path 5 and the distance between the sensor and the transfer origin of the tray 100, and the retainer 81 and the slide mechanism 82 may be moved to the transfer origin before the green compact 20 is conveyed to the transfer origin.

[Machining-Side Transfer Controller]

With reference to the process diagrams of FIGS. 5 and 6, a procedure through which the machining-side transfer controller controls the machining-side transfer device 9 will be described. FIG. 5 illustrates how the machining-side transfer device 9 moves the arm 92 from the standby stage 10 to one of the first-surface machining devices 31 and from the first-surface machining device 31 to the second-surface machining device 32, and how during this movement the machining-side transfer device 9 holds and replaces the green compact 20 with another green compact 20. FIG. 6 illustrates how the machining-side transfer device 9 moves the arm 92 from the second-surface machining device 32 to the standby stage 10, and how during this movement the machining-side transfer device 9 holds the unsintered material 30 and replaces the green compact 20 with the unsintered material 30. The machining-side transfer controller causes the machining-side transfer device 9 to repeat the action of attaching the green compact 20 on the standby stage 10 to one of the first-surface machining devices 31, transferring the green compact 20 from the first-surface machining device 31 to the second-surface machining device 32, and removing the unsintered material 30 from the second-surface machining device 32 and placing it onto the standby stage 10. Placing the unsintered material 30 onto the standby stage 10 may be done by replacing the green compact 20 on the standby stage 10 with the unsintered material 30.

The machining-side transfer controller includes an input unit, a memory, a retainer control unit, a retainer switching control unit, and an arm drive control unit. The input unit is configured to input setting data to be stored in the memory. The memory is configured to store the setting data, such as a predetermined location (installation location) of the green compact 20. The retainer control unit is configured to control the holding and releasing of either of the green compact 20 and the unsintered material 30 by each retainer 91. The retainer switching control unit is configured to control switching between holding and releasing of either of the green compact 20 and the unsintered material 30 by each retainer 91. The arm drive control unit is configured to control the movement of the arm 92 between the standby stage 10, either of the first-surface machining devices 31, and the second-surface machining device 32.

(First and Second GREEN COMPACTs)

In one machining apparatus 3 (one unit), the machining-side transfer device 9 controls the first and second green compacts 20 in the following manner.

First, when the tray 100 is placed onto the standby stage 10 by the conveying-side transfer device 8, the arm drive control unit lowers the arm 92 to cause one of the retainers 91 (first retainer 91) to be positioned outside the green compact 20. Next, the retainer control unit closes the first retainer 91 to grasp the outer periphery of the green compact 20.

The arm drive control unit raises the arm 92 and moves the arm 92 toward the first-surface machining devices 31 to bring the first retainer 91 close to one of the first-surface machining devices 31 (first first-surface machining device 31). After the chuck of the first first-surface machining device 31 grasps the green compact 20, the retainer control unit opens the first retainer 91 to release the green compact 20. This completes the passing of the green compact 20 to the first first-surface machining device 31. In the same manner, another green compact 20 is attached to the other first-surface machining device 31 (second first-surface machining device 31).

(Third Green Compact)

For the third green compact 20, first as in the case of the procedure for controlling the first and second green compacts 20, the arm drive control unit lowers the arm 92, the retainer control unit causes the first retainer 91 to hold the green compact 20, and the arm drive control unit raises the arm 92 (see the upper part of FIG. 5).

Next, the arm drive control unit moves the arm 92 toward the first-surface machining devices 31 to bring the other retainer 91 (second retainer 91) close to the first first-surface machining device 31. Next, the retainer control unit closes the second retainer 91 to grasp and remove the green compact 20 attached to the first first-surface machining device 31 (see the upper middle part of FIG. 5). When the second retainer 91 grasps this green compact 20, the chuck of the first first-surface machining device 31 releases the grasp of the green compact 20.

Next, the retainer switching control unit revolves both the retainers 91 about the arm 92 to cause the first retainer 91 to face the first first-surface machining device 31. The arm drive control unit brings the arm 92 close to the first first-surface machining device 31, and causes the chuck to grasp the green compact 20 on the first retainer 91. After the chuck grasps the green compact 20, the retainer control unit causes the first retainer 91 to release the green compact 20. The green compact 20 on the first first-surface machining device 31 is thus replaced with the green compact 20 on the standby stage 10 (see the lower middle part of FIG. 5).

Next, the arm drive control unit rotates the arm 92. At the same time, the retainer switching control unit revolves both the retainers 91 to bring the second retainer 91 close to the second-surface machining device 32, and causes the chuck of the second-surface machining device 32 to grasp the green compact 20 on the second retainer 91. After the chuck grasps this green compact 20, the retainer control unit causes the second retainer 91 to release the green compact 20. Thus, the green compacts 20 are individually attached to two first-surface machining devices 31 and one second-surface machining device 32 (see the lower part of FIG. 5).

(Fourth Green Compact)

For the fourth green compact 20, after the second-surface machining device 32 completes machining of the green compact 20 to produce the unsintered material 30, the arm drive control unit moves the arm 92 toward the second-surface machining device 32 to bring the second retainer 91 close to the second-surface machining device 32. Next, the retainer control unit closes the second retainer 91 to grasp and remove the unsintered material 30 grasped by the chuck of the second-surface machining device 32 (see the upper part of FIG. 6).

Next, the arm drive control unit moves the arm 92 toward the standby stage 10 to move the first retainer 91 to above the standby stage 10. Next, the arm drive control unit lowers the arm 92 to cause the first retainer 91 to be positioned outside the green compact 20 on the standby stage 10.

Next, the retainer control unit closes the first retainer 91 to grasp the outer periphery of the green compact 20. Next, the arm drive control unit raises the arm 92 (see the upper middle part of FIG. 6).

Next, the retainer switching control unit revolves both the retainers 91 to cause the second retainer 91 to face the standby stage 10. Then, after the arm drive control unit lowers the arm 92 to bring the second retainer 91 close to the standby stage 10, the retainer control unit opens the second retainer 91 to place the unsintered material 30 onto the tray 100 on the standby stage 10 (see the lower middle part of FIG. 6).

Next, the arm drive control unit raises the arm 92 (see the lower part of FIG. 6).

In the subsequent control operation, in substantially the same manner as the control operation for the third green compact 20 described above, the green compact 20 which one of the first-surface machining devices 31 has completed machining is replaced by the green compact 20 held on the standby stage 10, and the green compact 20 replaced is attached to the second-surface machining device 32. Note that this subsequent control operation differs from the control operation for the third green compact 20 in that the retainer switching control unit revolves the retainers 91 before the green compact 20 on the first-surface machining device 31 is replaced.

(Fifth and Further Green Compacts)

The machining-side transfer device 9 controls the fifth and further green compacts 20 in the same manner as the control operation for the fourth green compact 20 described above, and repeats the control operation.

[Movements of Green Compacts and Unsintered Materials]

Figure 7:
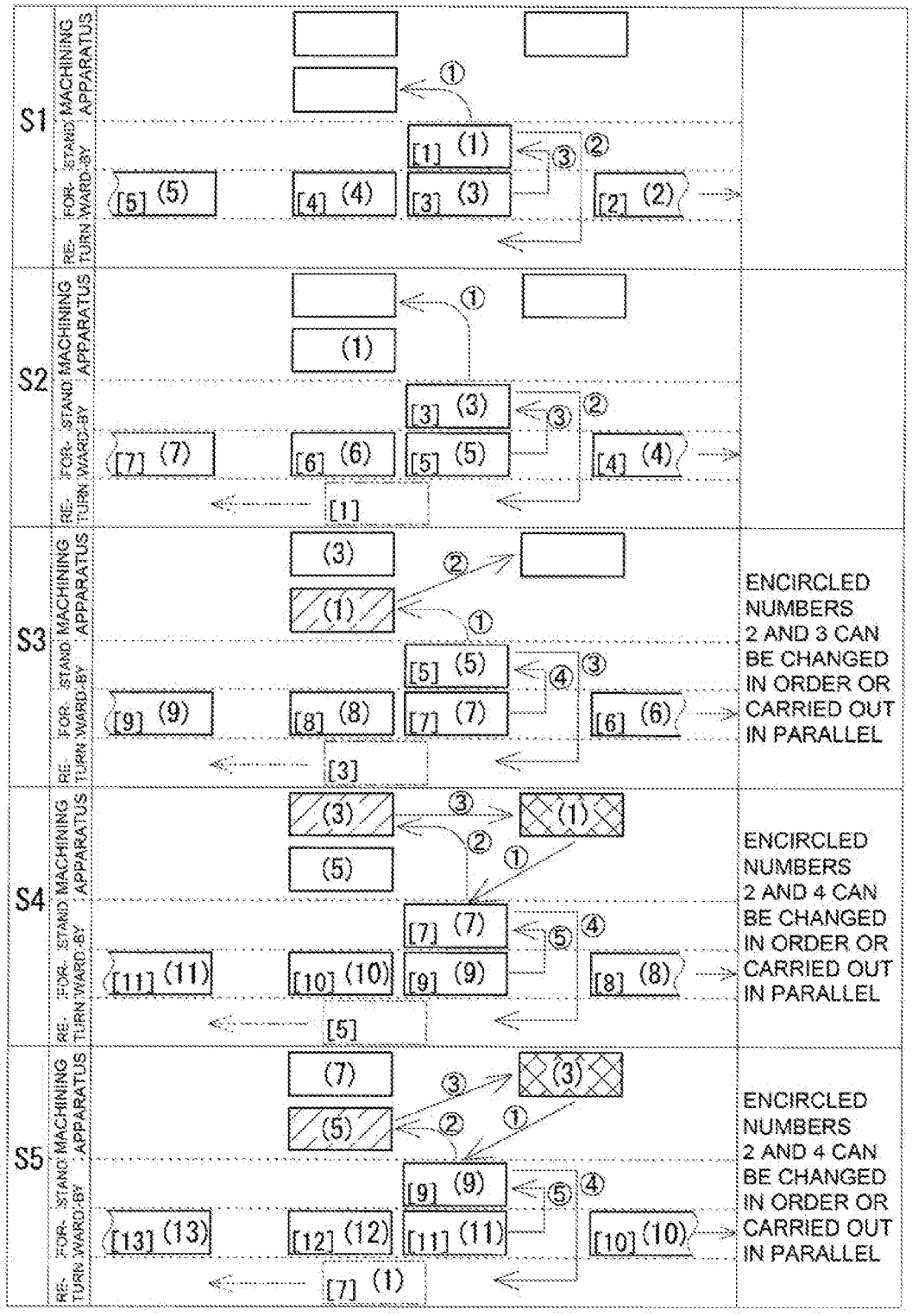
FIG. 7 is a diagram illustrating how the conveying-side transfer device and the machining-side transfer device included in the sintered body manufacturing apparatus of the first embodiment operate to transfer green compacts and unsintered materials.

With reference to FIG. 7, a description will be given of how the green compacts and the unsintered materials are moved by the actions of the conveying-side transfer device and the machining-side transfer device described with reference to FIGS. 3 to 6. In the drawing, each number in round brackets is a green compact number, each number in square brackets is a tray number, and encircled numbers indicate the order of actions. In the "machining apparatus" row, boxes on the left side of the drawing each represent the first-surface machining device, and a box on the right side of the drawing represents the second-surface machining device. Empty boxes each indicate that no green compact is placed in the machining device. A number in round brackets in a box indicates that a green compact with a number corresponding thereto is placed. A hatched box indicates that machining performed by the first-surface machining device has been completed. A cross-hatched box indicates that machining performed by both the first-surface machining device and the second-surface machining device has been completed, that is, an unsintered material has been produced. Also, "standby" represents the standby stage, "forward" represents the green compact conveying path, and "return" represents the unsintered material conveying path. Hereinafter, movements of green compacts and unsintered materials in the machining apparatus on the upstream side will be described as an example, and their movements in the machining apparatus on the downstream side are not described or shown, as they are the same as those on the upstream side.

(Step S0)

Although not shown, no green compact is attached to any machining device at the start of manufacture. Then the conveying-side transfer device transfers a tray [1] having a green compact (1) thereon from the green compact conveying path onto the standby stage (see step S1 at the top of FIG. 7 for the green compact and tray numbers). A tray [2] having a green compact (2) thereon is conveyed by the green compact conveying path to the machining apparatus on the downstream side without being transferred to the standby stage by the conveying-side transfer device.

On the green compact conveying path, a tray [3] having a green compact (3) thereon and the subsequent trays are sequentially conveyed.

(Step S1)

<Machining-Side Transfer Device>

By the machining-side transfer device, the green compact (1) on the standby stage is attached to one of the first-surface machining devices (first first-surface machining device).

<Conveying-Side Transfer Device>

By the conveying-side transfer device, the tray [1], which is now empty, is transferred to the unsintered material conveying path. Next, by the conveying-side transfer device, the tray [3] is transferred to the standby stage. Then, a tray [4] having a green compact (4) thereon is conveyed by the green compact conveying path to the machining apparatus on the downstream side without being transferred to the standby stage by the conveying-side transfer device.

(Step S2)

<Machining-Side Transfer Device>

By the machining-side transfer device, the green compact (3) on the standby stage is attached to the other first-surface machining device (second first-surface machining device).

<Conveying-Side Transfer Device>

The movements of green compacts (unsintered materials) in step S2 and the following steps are the same as those in step S1, except that the tray and green compact numbers treated herein are the subsequent odd numbers, and thus will not be described in the following steps.

(Step S3)

A green compact (5) on the standby stage is held by one of the retainers (first retainer) of the machining-side transfer device. Next, the green compact (1) which the first first-surface machining device has completed machining is removed by the other retainer (second retainer) of the machining-side transfer device, and the green compact (5) in the first retainer is attached to the first first-surface machining device. Next, the green compact (1) in the second retainer is attached to the second-surface machining device. Although not described, the conveying-side transfer device may transfer a tray [5] to the unsintered material conveying path any time after the first retainer holds the green compact (5). That is, the transfer may take place either simultaneously with or before attachment of the green compact (1) to the second-surface machining device.

(Step S4)

The unsintered material (1) produced upon completion of machining by the second-surface machining device is taken out by the first retainer of the machining-side transfer device. Next, a green compact (7) on the standby stage is held by the second retainer of the machining-side transfer device, and the unsintered material (1) held by the first retainer of the machining-side transfer device is placed onto a tray [7] on the standby stage. Then, in the same manner as step S3, the green compact (3) which the second first-surface machining device has completed machining is removed, the green compact (7) is attached to the second first-surface machining device, and the green compact (3) is attached to the second-surface machining device. Note that the first-surface machining device from which the green compact (3) is removed and to which the green compact (7) is attached is different from that in step S3. The conveying-side transfer device may transfer the tray [7] to the unsintered material conveying path either simultaneously with or before the removal of the green compact (3), as long as the transfer is after the unsintered material (1) is placed onto the tray [7].

(Step S5)

The movements of green compacts and unsintered materials are the same as those in step S4, except that the tray, green compact, and unsintered material numbers treated herein are the subsequent odd numbers, and that the first-surface machining device from which the green compact which the first-surface machining device has completed machining is removed and to which another green compact is attached is different from that in the previous step.

(Step S6 and Subsequent Steps)

Steps S4 and S5 are repeated.

[Timing Diagram]

Figure 8:
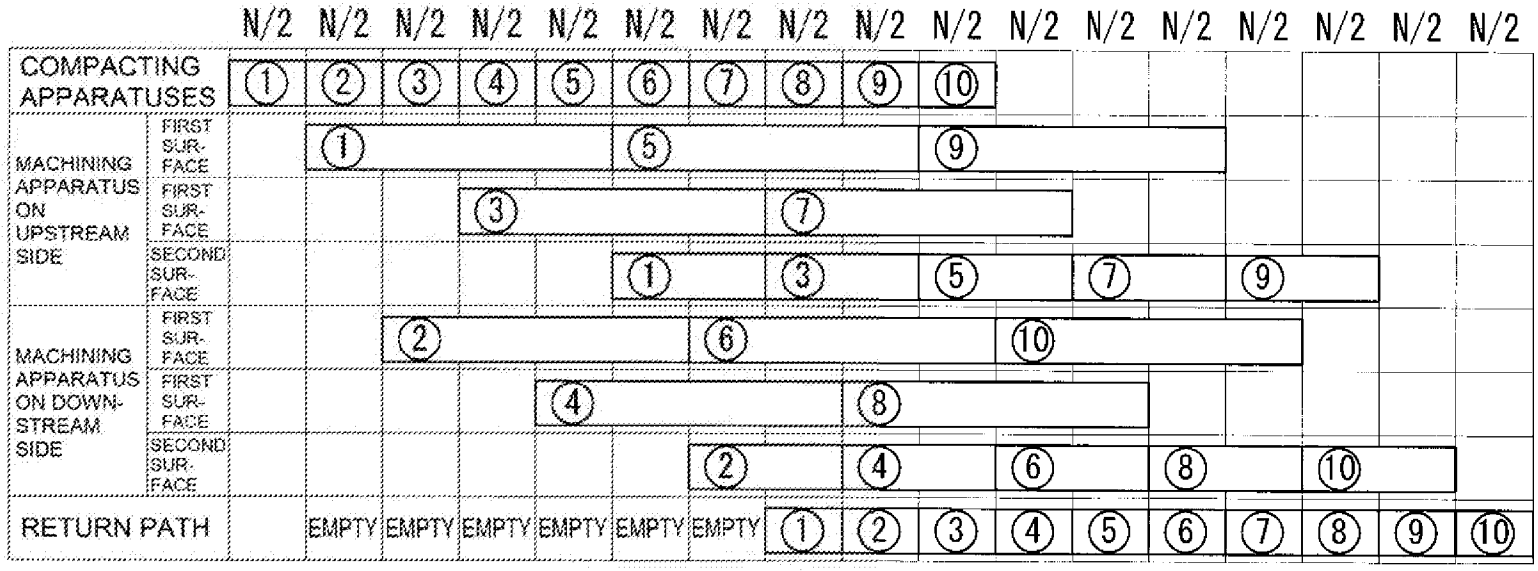
FIG. 8 is a timing diagram for compacting apparatuses and machining apparatuses included in the sintered body manufacturing apparatus of the first embodiment.

With reference to the timing diagram of FIG. 8, the timing of actions of the conveying-side transfer device and the machining-side transfer device will be described. The timing diagram of FIG. 8 is for the sintered body manufacturing apparatus that includes two compacting apparatuses and two machining apparatuses (two units). Each of the machining apparatuses includes two first-surface machining devices and one second-surface machining device. Encircled numbers in FIG. 8 are green compact numbers. Each cell represents "N/2" seconds, and a box extending over cells indicates that machining continues for more than "N/2" seconds. "Empty" in the "return path" row indicates that a tray is conveyed by the unsintered material conveying path without having anything thereon.

With two compacting apparatuses each capable of producing one green compact every N seconds, one green compact is produced every "N/2" seconds. When it takes a total of 3N seconds for one machining apparatus to perform machining on one green compact (i.e., 2N seconds for the first surface, N seconds for the second or back surface), the conveying-side transfer device and the machining-side transfer device are driven such that the green compacts are attached to each machining apparatus and to the first-surface machining device in the machining apparatus, at the following timing.

That is, green compacts are alternately attached to the machining apparatuses on the upstream and downstream sides at intervals of "N/2" seconds. Specifically, in "N/2" seconds after one green compact is attached to the machining apparatus on the upstream side, another green compact is attached to the machining apparatus on the downstream side. Then, after another "N/2" seconds, another green compact is attached to the machining apparatus on the upstream side. This goes on repeatedly. Thus, in each machining apparatus, green compacts are alternately attached to one and the other first-surface machining devices (first and second first-surface machining devices) at intervals of N seconds. Specifically, in the machining apparatus on the upstream side, in "N" seconds after one green compact is attached to the first first-surface machining device, another green compact is attached to the second first-surface machining device. Then, after another "N" seconds, the green compact on the first first-surface machining device is removed and replaced with another green compact. At the same time, the green compact removed from the first first-surface machining device is attached to the second-surface machining device. That is, the attachment of one green compact to the second-surface machining device also takes place every "N" seconds.

This also applies to the machining apparatus on the downstream side.

As described above, when one green compact is attached to the machining apparatus on the upstream side, another green compact is attached to the machining apparatus on the downstream side after an interval ("N/2" seconds) which is equal to the production time required to produce each green compact. This means that, in each machining apparatus, after one green compact is attached to the first first-surface machining device, another green compact is attached to the second first-surface machining device in "N" seconds. Thus, even when there is a large difference between the production time (N/2) required to produce each green compact and the total machining time (3N) required to perform machining on each green compact, the transfer time for each unsintered material transferred from either of the machining apparatuses can be made substantially the same as the production time required to produce each green compact. The process from the production of green compacts to the production of unsintered materials can thus be carried out continuously without interruption.

[Advantageous Effects of Sintered Body Manufacturing Apparatus]

With the sintered body manufacturing apparatus described above, even when there is a large difference between the production time required for one compacting apparatus to produce each green compact and the total machining time required to perform machining on each green compact, the process from compaction to machining can be continuously carried out in series. This can improve productivity in the manufacture of sintered bodies. Also, a series of steps from the transfer of a green compact to the green compact conveying path to the transfer of an unsintered material to the sintering furnace can be all automatically done without human intervention. This can reduce damage associated with human contact with green compacts and unsintered materials, and can reduce loss associated with human intervention.

[Sintered Body Manufacturing Method]

A sintered body manufacturing method includes a compacting step of producing a green compact, a machining step of performing a cutting operation on the green compact to produce an unsintered material, and a sintering step of sintering the unsintered material. A main feature of the sintered body manufacturing method is that the compacting and machining steps are carried out in an in-line manner. Here, the manufacture of sintered bodies involves using the sintered body manufacturing apparatus 1.

(Compacting Step)

The compacting step involves pressing a raw powder containing a metal powder into a green compact. The green compact is a material of a machine part made into a product after being sintered (described below). As described above, a press machine including a compacting die assembly appropriate for the shape of the machine part may be used for the pressing.

The type of the metal powder can be appropriately selected in accordance with the type of the machine part. For example, the metal powder may be an iron powder or an iron alloy powder primarily composed of iron. The green compact preferably contains a lubricant.

This is because when a green compact is produced by compressing the raw powder as described above, using the raw powder containing a lubricant enhances compaction lubricity and improves green compactibility. The shape and size of the green compact are designed to fit the final shape of the machine part. The compacting pressure ranges, for example, from 250 MPa to 800 MPa.

(Machining Step)

The machining step involves performing a cutting operation on a green compact to produce an unsintered material. As described above, a typical cutting operation may be hole making. Hole making conditions may be appropriately selected, for example, in accordance with the drill type and the size and location of a hole to be made. The cutting speed at the drill tip is normally about 200 m/min, but it is possible to double this to 400 m/min or more.

(Sintering Step)

A sintered body is produced by sintering a green compact. The sintering is performed by the sintering unit. The sintering temperature required for the sintering may be appropriately selected in accordance with the material of the green compact. For example, the sintering temperature for a ferrous sintered body may be 1000° C. or above, 1100° C. or above, or 1200° C. or above.

The sintering time ranges from about 20 minutes to about 150 minutes.

[Advantageous Effects of Sintered Body Manufacturing Method]

In the sintered body manufacturing method described above, the compacting and machining steps are carried out in an in-line manner. Since this shortens the process from compaction to machining, sintered bodies can be manufactured with high productivity.

INDUSTRIAL APPLICABILITY

A sintered body manufacturing apparatus and a sintered body manufacturing method according to an aspect of the present invention can be suitably used for manufacturing various types of general structural parts (i.e., sintered machine parts, such as sprockets, rotors, gears, rings, flanges, pulleys, and bearings).

REFERENCE SIGNS LIST

1: sintered body manufacturing apparatus
2: compacting apparatus
20: green compact
3: machining apparatus
30: unsintered material
31: first-surface machining device
32: second-surface machining device
4: sintering furnace
5: green compact conveying path (forward path)
6: unsintered material conveying path (return path)
7: green compact transfer device
71: retainer
72: arm
8: conveying-side transfer device
81: retainer
82: slide mechanism
82*a*: vertical slide portion
82*b*: horizontal slide portion
9: machining-side transfer device
91: retainer
92: arm
10: standby stage
13: marking apparatus
14: unsintered material transfer device
100: tray

The invention claimed is:

1. A sintered body manufacturing apparatus comprising:

a compacting apparatus configured to press a raw powder containing a metal powder into a green compact;

a machining apparatus configured to perform a cutting operation on the green compact to produce an unsintered machined compact;

a green compact conveying path configured to connect the compacting apparatus in series to the machining apparatus to convey green compacts one by one from the compacting apparatus to the machining apparatus, a standby stage disposed between the green compact conveying path and the machining apparatus, the standby stage being configured to temporarily keep the green compact on standby thereon before the green compact on the green compact conveying path is moved to the machining apparatus and temporarily keep the unsintered machined compact on standby thereon before the unsintered machined compact on the machining apparatus is transferred to a sintering furnace; and a conveying-side transfer device configured to hold and transfer the green compact on the green compact conveying path to the standby stage, and hold and transfer the unsintered machined compact on the standby stage to the sintering furnace.

2. The sintered body manufacturing apparatus according to claim 1, further comprising a green compact transfer device configured to hold and transfer the green compact produced by the compacting apparatus to the green compact conveying path.

3. The sintered body manufacturing apparatus according to claim 1, wherein if "M/N=integer" is satisfied, where N represents production time in seconds required for one compacting apparatus to produce each green compact and M represents total machining time in seconds required to perform the cutting operation on each green compact, the machining apparatus includes M/N cutting devices, the sintered body manufacturing apparatus further comprising a machining-side transfer device configured to hold the green compact on the standby stage and attach the held green compact to each cutting device, and remove the unsintered machined compact from the cutting device and place the removed unsintered machined compact onto the standby stage, wherein the machining-side transfer device is configured to sequentially attach the green compacts to each cutting device every N seconds.

4. The sintered body manufacturing apparatus according to claim 3, wherein one of the M/N cutting devices is a first-surface machining device configured to perform machining from a first surface of the green compact, and another of the MIN cutting devices is a second-surface machining device configured to perform machining from a second surface of the green compact.

5. The sintered body manufacturing apparatus according to claim 4, wherein the machining-side transfer device includes two retainers each configured to hold and release either of the green compact and the unsintered machined compact, and an arm connected to the two retainers and configured to move the retainers between the standby stage, the first-surface machining device, and the second-surface machining device; and the retainers are each freely switchable between holding and releasing the green compact and between holding and releasing the unsintered machined compact.

6. The sintered body manufacturing apparatus according to claim 3, further comprising a marking apparatus disposed between the machining apparatus and the sintering furnace and configured to provide a marking for identifying a machining history of the unsintered machined compact.

7. The sintered body manufacturing apparatus according to claim 1, further comprising a tray configured to hold each green compact thereon and conveyed by the green compact conveying path.

8. The sintered body manufacturing apparatus according to claim 1, wherein the metal powder is an iron powder or an iron alloy powder primarily composted of iron.

9. The sintered body manufacturing apparatus according to claim 2, further comprising an unsintered machined compact conveying path extending adjacent and parallel to the compact conveying path, the compact conveying path and the unsintered machined compact conveying path forming a continuous conveying path.

10. The sintered body manufacturing apparatus according to claim 7, further comprising an unsintered machined compact transfer device configured to transfer the unsintered machined compact to a marking apparatus disposed between the machining apparatus and the sintering furnace, and then transfer the unsintered machined compact from the marking apparatus to the sintering furnace by holding only unsintered machined compact placed on the tray on a unsintered machined compact conveying path.

* * * * *